US012251063B2

(12) United States Patent
Thyson et al.

(10) Patent No.: US 12,251,063 B2
(45) Date of Patent: Mar. 18, 2025

(54) CLEANING ELEMENT

(71) Applicant: CARL FREUDENBERG KG, Weinheim (DE)

(72) Inventors: Diana Thyson, Weinheim (DE); Dietmar van Loyen, Enkenbach-Alsenborn (DE); Eduard Sanz, Barcelona (ES)

(73) Assignee: CARL FREUDENBERG KG, Weinheim (DE)

( * ) Notice: Subject to any disclaimer, the term of this patent is extended or adjusted under 35 U.S.C. 154(b) by 47 days.

(21) Appl. No.: 17/768,222

(22) PCT Filed: Oct. 6, 2020

(86) PCT No.: PCT/EP2020/077991
§ 371 (c)(1),
(2) Date: Apr. 12, 2022

(87) PCT Pub. No.: WO2021/073955
PCT Pub. Date: Apr. 22, 2021

(65) Prior Publication Data

US 2024/0115105 A1 Apr. 11, 2024

(30) Foreign Application Priority Data

Oct. 14, 2019 (DE) ..... 10 2019 127 619.5

(51) Int. Cl.
*A47L 13/24* (2006.01)

(52) U.S. Cl.
CPC ..... *A47L 13/24* (2013.01)

(58) Field of Classification Search
CPC ..... A47L 13/24; A47L 13/20; A47L 13/252; A47L 13/255
USPC ..... 15/228, 229.1
See application file for complete search history.

(56) References Cited

U.S. PATENT DOCUMENTS 1,977,948 A * 10/1934 McNamara ..... A47L 13/20 15/229.1
2,403,652 A 7/1946 Fullerton
3,520,117 A * 7/1970 Metzler ..... A01D 44/00 56/8
9,750,384 B2 9/2017 Eisenhut et al.
(Continued)

FOREIGN PATENT DOCUMENTS

CN 202553849 U 11/2012
DE 102013006194 A1 10/2014
(Continued)

*Primary Examiner* — Tom Rodgers
(74) *Attorney, Agent, or Firm* — LEYDIG, VOIT & MAYER, LTD.

(57) ABSTRACT

A cleaning element includes: a support body; and textile strings that are elongate. At least part of the textile strings includes a plurality of strands. A first strand and a second strand of the plurality of strands run longitudinally along the at least part of the textile strings, and a third strand of the plurality of strands runs transversely to the longitudinal extent of the at least part of the textile strings. The plurality of strands includes a fourth strand. The fourth strand runs longitudinally along the at least part of the textile strings. The fourth strand is disposed between the first strand and the second strand. The first, second, third, and fourth strands are fixed to one another by a support thread.

7 Claims, 10 Drawing Sheets

(56) References Cited

U.S. PATENT DOCUMENTS

| | | | | |
|---|---|---|---|---|
| 2016/0083874 | A1* | 3/2016 | Huang | D03D 1/0023 15/228 |
| 2017/0260658 | A1 | 9/2017 | Weis | |
| 2020/0107692 | A1 | 4/2020 | Thyson | |

FOREIGN PATENT DOCUMENTS

| | | | |
|---|---|---|---|
| DE | 102014012492 | A1 | 3/2016 |
| DE | 102017004809 | B3 | 9/2018 |
| ES | 1072897 | U | 10/2010 |
| FR | 3050921 | A1 | 11/2017 |
| RU | 2566479 | C2 | 10/2015 |
| RU | 185804 | U1 | 12/2018 |

* cited by examiner

CLEANING ELEMENT

CROSS-REFERENCE TO PRIOR APPLICATIONS

This application is a U.S. National Phase application under 35 U.S.C. § 371 of International Application No. PCT/EP2020/077991, filed on Oct. 6, 2020, and claims benefit to German Patent Application No. DE 10 2019 127 619.5, filed on Oct. 14, 2019. The International Application was published in German on Apr. 22, 2021 as WO 2021/073955 under PCT Article 21(2).

FIELD

The invention relates to a cleaning element comprising a support body and textile strings configured so as to be elongate, wherein at least part of the strings comprise a plurality of strands.

BACKGROUND

The strings in a cleaning element of this type are fastened to the support body such that the strings hang from the support body in the shape of a bell. Furthermore, a handle is fastened on the other side to the support body. The cleaning element conjointly with the support body and the strings, and the handle fastened to the support body, form a cleaning apparatus in the form of a mop, wherein the cleaning element in this context may also be referred to as the mop head. Mops serve for the wet cleaning of floors. Mops of this type are also known as string mops.

The strings here can be configured as strips of a comparatively large or small width made from a textile fabric, for example a non-woven fabric. Strings configured in such a manner have a comparatively large contact face in relation to the floor to be cleaned. However, it is disadvantageous here that strings of this type are relatively stiff and inflexible during the mopping procedure. It is also known for strings to be configured from individual fiber strands. The latter can move more flexibly during cleaning. It is known here for the strings to be configured from single strands or a plurality of strands.

Strings which comprise a plurality of strands are in most instances comparatively voluminous and as a result can absorb a larger quantity of cleaning liquid and contaminations. As a result, the performance of the cleaning element in terms of the area covered is increased. However, at the same time the wet weight of the cleaning element is also increased, this impeding the application. The textile strings here can be configured from man-made fibers as well as from natural fibers. The use of man-made fibers or natural fibers here depends on the requirements of the cleaning jobs and on sustainability.

In the mop head known from DE 10 2017 004 809 B3, the strings fastened to the support body comprise in each case three strands which are disposed next to one another and are fixed to one another. As a result, the strings have a flat design in the shape of strips.

SUMMARY

In an embodiment, the present invention provides a cleaning element, comprising: a support body; and textile strings configured so as to be elongate, wherein at least part of the textile strings comprise a plurality of strands, wherein a first strand and a second strand of the plurality of strands run longitudinally along the at least part of the textile strings, and a third strand of the plurality of strands runs transversely to the longitudinal extent of the at least part of the textile strings, wherein the plurality of strands comprises a fourth strand, wherein the fourth strand runs longitudinally along the at least part of the textile strings, wherein the fourth strand is disposed between the first strand and the second strand, and wherein the first, second, third, and fourth strands are fixed to one another by a support thread.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
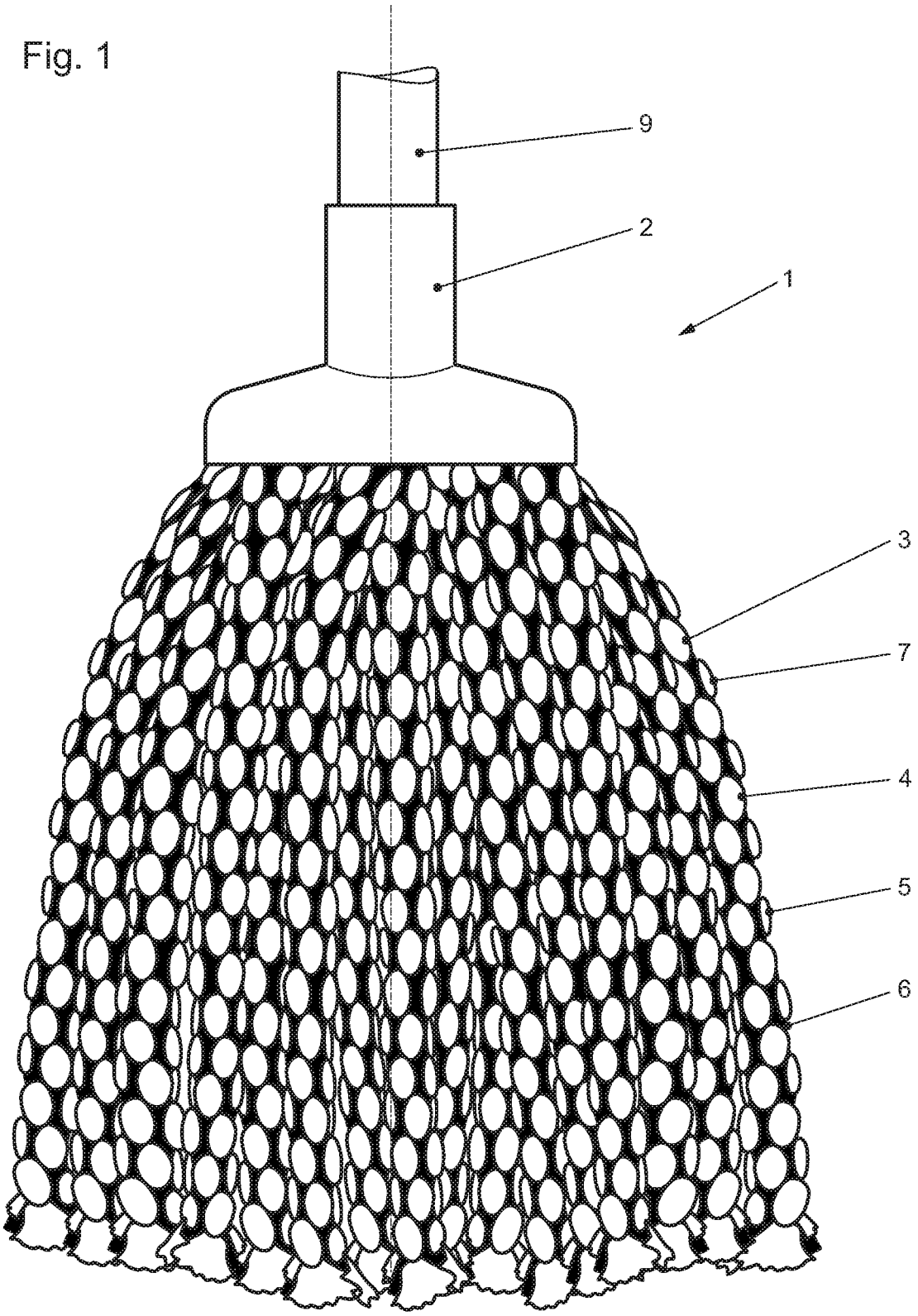
FIG. 1 shows a cleaning element in a perspective illustration.

In an embodiment, the present invention provides a cleaning element which has an improved cleaning performance.

In order for the object to be achieved, the cleaning element comprises a support body and textile strings configured so as to be elongate, wherein at least part of the strings comprise a plurality of strands, wherein a first strand and a second strand run longitudinally along the strings, and a third strand runs transversely to the longitudinal direction of the strings.

The third strand is preferably disposed in a plane which is different from the horizontal plane formed by the first strand and the second strand. The third strand that runs transversely to the longitudinal direction defines a dedicated horizontal plane. The latter can run above, below or transversely to the horizontal plane of the first and the second strand. As a result of this arrangement, a three-dimensional string results already due to reasons of production. The string can be even more deformed in a three-dimensional manner by the influence of moisture and/or heat.

Natural fibers as well as man-made fibers vary their length when in contact with moisture and/or heat. The moisture here can emanate from the air or be cleaning liquid. Heat can be introduced during the cleaning procedure, for example by way of warm cleaning water, or in the production process of the strings. When in contact with moisture and/or heat, the fibers decrease in length, and the diameter increases in a corresponding manner. The fibers shrink. The fibers of the textile strands are configured from natural fibers or plastics-material fibers and accordingly likewise change their length and shrink when in contact with moisture and/or heat. The first strand and the second strand as well as the third strand contract and decrease in length when in contact with moisture and/or heat. As a result of the third strand running transversely to the longitudinal extent of the strings, the string formed from the strands not only decreases in length when in contact with moisture, but a three-dimensional deformation also takes place. This results in three-dimensionally shaped, voluminous strings which have a high cleaning performance.

In this context, it is conceivable in principle for the three-dimensional shaping of the string to be achieved in that the third strand that runs transversely to the longitudinal extent of the string is pre-tensioned to a different level. For example, during the production of the string the third strand can be processed using a higher level of pre-tensioning than the first strand and the second strand.

The strings comprise a fourth strand, wherein the fourth strand, like the first strand and the second strand, runs longitudinally along the strings, and wherein the fourth strand is disposed between the first strand and the second strand. The third strand here preferably runs so as to zigzag between the first strand and the second strand, straddling the fourth strand. According to an advantageous alternative design embodiment, the third strand runs between the first strand and the fourth strand as well as between the third strand and the fourth strand. When in contact with moisture, the strands decrease in length, wherein the first strand and the second strand, by virtue of the transversely running third strand, move in the direction of the fourth strand.

The strands of the strings form a knitted fabric. The strands here are fixed to one another by means of a support thread. The support thread in comparison to the strands has a significantly lower mass per unit length and serves exclusively for fixing the strands to one another. As a result of the support thread, the third strand by means of loop formation can be linked to the other strands that run in the longitudinal direction.

The first strand, the second strand and the third strand can form a knitted fabric. The strands here are connected to one another by loop formation and thus firmly fixed to one another. This results in a dimensionally stable formation, wherein the third strand is fixed to the first strand and to the second strand such that the third strand runs transversely to the longitudinal extent of the string.

The third strand preferably runs so as to zigzag between the first strand and the second strand. The third strand here can in each case run at an angle of 45° between the first strand and the second strand. When in contact with moisture, all three strands decrease in length, wherein the first strand and the second strand, which run longitudinally along the strings, swell and the third strand modifies the relative position of the first strand and the second strand such that a three-dimensional formation results.

In further alternative design embodiments it is conceivable that further strands are provided that can run in the longitudinal direction or in the transverse direction.

The strings, when viewed in cross section, are preferably shaped so as to be three-dimensional. As a result of the third strand being in each case disposed between the first strand and the fourth strand as well as between the second strand and the fourth strand, the string rolls up, wherein the first strand and the second strand move toward one another. As a result, the string forms a type of tube which is open between the first strand and the second strand. A string of this type has a particularly large volume and is particularly well suited to absorbing cleaning liquid. A further advantage lies in that contamination can be particularly well absorbed in the cavity formed in the interior of the strand and be released into the mopping water again.

The strands can be configured from a plurality of yarns. It is in particular conceivable here that the strands are configured from mutually dissimilar yarns. For example, the first strand and the second strand can be configured from soft yarns which have a particularly high capacity for water absorption, and the third strand can be configured from a yarn which has a comparatively low capacity for water absorption but has an abrasive effect. Depending on the specific application, it can also be advantageous for the strands running in the longitudinal direction to be designed so as to be abrasive, and for the transversely running strands to be embodied with a high capacity for water absorption.

The yarns are configured from fibers, wherein the fibers can be natural fibers or man-made fibers. Cotton, linen, wool or silk is in particular considered for strands configured from natural fibers. However, other natural fibers may also be used. The strands can also be configured from semi-synthetic fibers such as viscose, for example. In the case of man-made fibers, strands configured in particular from polyamide, polypropylene, polyester or polylactides are considered. The use of polypropylene here is particularly advantageous for the transversely running strands. Metallized yarns may also be used there.

Several Design Embodiments of the Cleaning Element According to the Invention Will be Explained in More Detail Hereunder by Means of the Figures. In the Schematic Figures:

FIG. 1 shows a cleaning element 1 in the form of a mop head, comprising a support body 2 and textile strings 3. The strings 3 on the one side of the support body 2 are fastened such that the strings 3 hang from the support body 2 in the shape of a bell. On the other side, the support body 2 has a receptacle for a handle 9, wherein the receptacle is preferably configured such that the handle 9 can be fastened to the support body 2 by means of a screw fastening. Alternatively, a clamping fastening of the handle 9 on the cleaning element is also conceivable. The cleaning element 1 conjointly with the support body 2 and the strings 3, and the handle 9 fastened to the support body 2, forms a cleaning apparatus, in the present case a mop, or a string mop. The mop serves for the wet cleaning of floors.

The textile strings 3 are configured so as to be elongate and comprise a plurality of strands 4, 5, 7. A first strand 4, a second strand 5 and a fourth strand 7 here run longitudinally along the strings. A third strand 6 runs transversely to the longitudinal extent of the strings 3. The first strand 4, the second strand 5, the third strand 6 and the fourth strand 7 are connected by loop formation. The fourth strand 7 here runs between the first strand 4 and the second strand 5. The third strand 6 runs so as to zigzag between the first strand 4 and the fourth strand 7 as well as between the second strand 5 and the fourth strand 7.

The Strands 4, 5, 6, 7 are Fixed to One Another by Means of a Support Thread 8. The Strands 4, 5, 6, 7 and the Support Thread 8 here Form a Knitted Fabric.

The strands 4, 5, 6, 7 comprise a plurality of yarns, wherein the yarns are configured from man-made fibers. In the present design embodiment, the first strand 4, the second strand 5 and the fourth strand 7 are configured from polyester, and the third strand 6 likewise from polyester. The support thread 8 is configured from polyamide. In principle however, other material combinations are also conceivable here. The yarns can also be configured from natural fibers or semi-synthetic fibers, or comprise such natural fibers or semi-synthetic fibers. Material blends are also conceivable.

The strings 3, when viewed in cross section, are shaped so as to be three-dimensional. In the present design embodiment, the strings 3, by virtue of the profile of the strands 4, 5, 6, 7 according to the invention, are shaped so as to be annular. When in contact with moisture, the yarns shrink such that the strands 4, 5, 6, 7 decrease in length, and the transversely running third strands 6 have the effect that the string 3 rolls up, wherein the first strand 4 and the second strand 5 move toward one another. A cavity running in the longitudinal direction is configured in the interior of the string 3.

Figure 2:
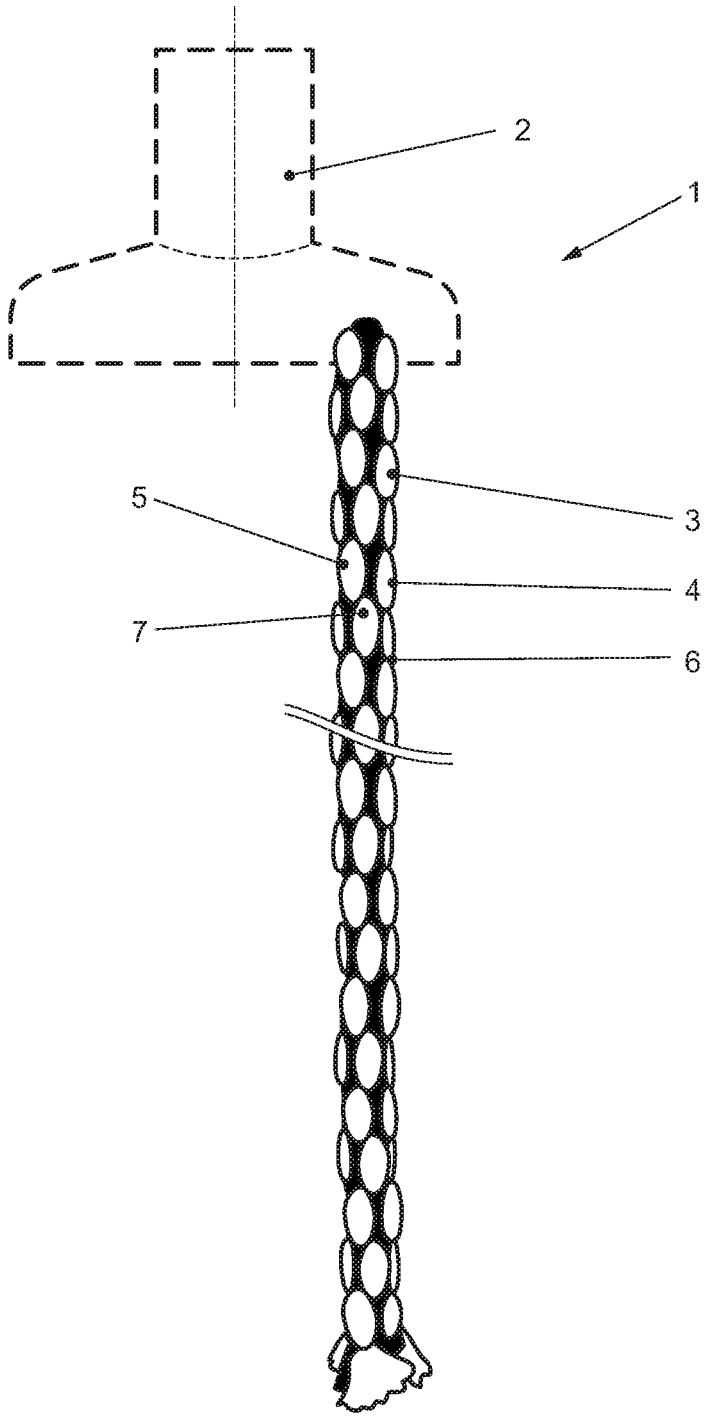
FIG. 2 shows a string of the cleaning element in detail.

FIG. 2 shows in detail a string 3 described in FIG. 1.

Figure 3:
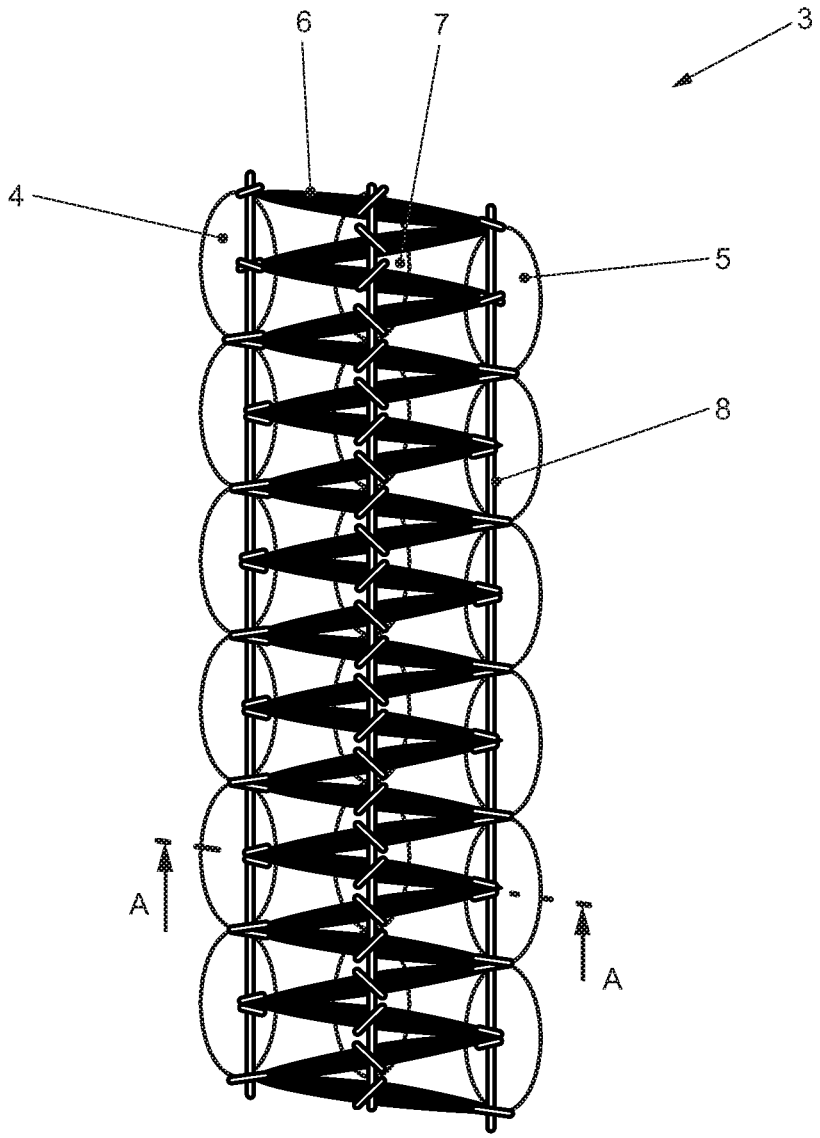
FIG. 3 shows a first design embodiment of the string shown in FIG. 2 in the state as produced.

FIG. 3 shows a first design embodiment of a string 3. It can be seen in this figure that the string 3 after production is configured so as to be flat and strip-shaped, and the third strand 6 runs so as to zigzag between the first strand 4 and the second strand 5. The third strand 6 here straddles in each case the fourth strand 7. The third strand 6 by means of a support thread 8 is fixed to the other strands 4, 5, 7 by loop formation.

Figure 4:
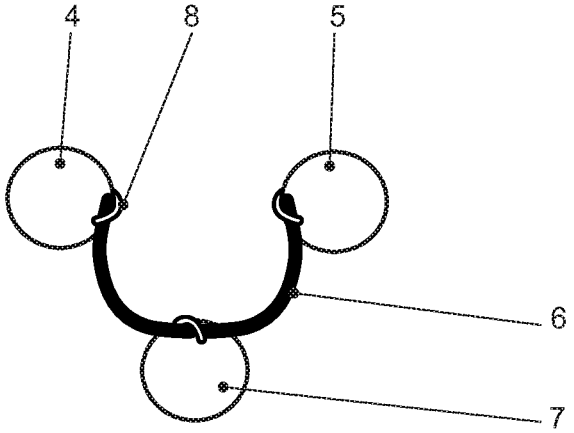
FIG. 4 shows the string shown in FIG. 3 in a sectional view in the section plane A-A.
Figure 4:
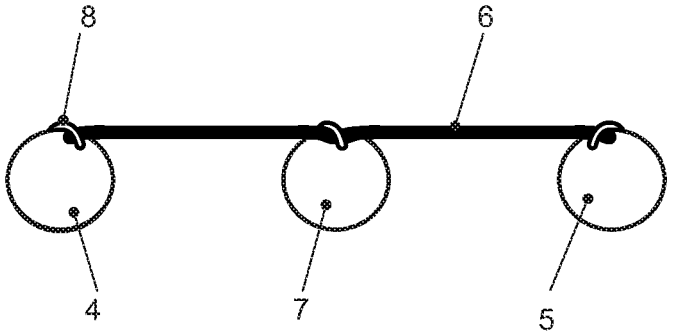

FIG. 4 shows the string 3 shown in FIG. 3 in a sectional view in the section plane A-A. The lower illustration here shows the string 3 during or immediately after production. The string 3 is configured so as to be flat and substantially strip-shaped. The upper illustration shows the string 3 after production, under the effect of the pre-tensioning resulting from production, or under the effect of moisture and/or heat. The string 3 has been deformed in a three-dimensional manner and rolled up so as to form a roll. The first strand 4 and the second strand 5 have moved toward one another.

Figure 5:
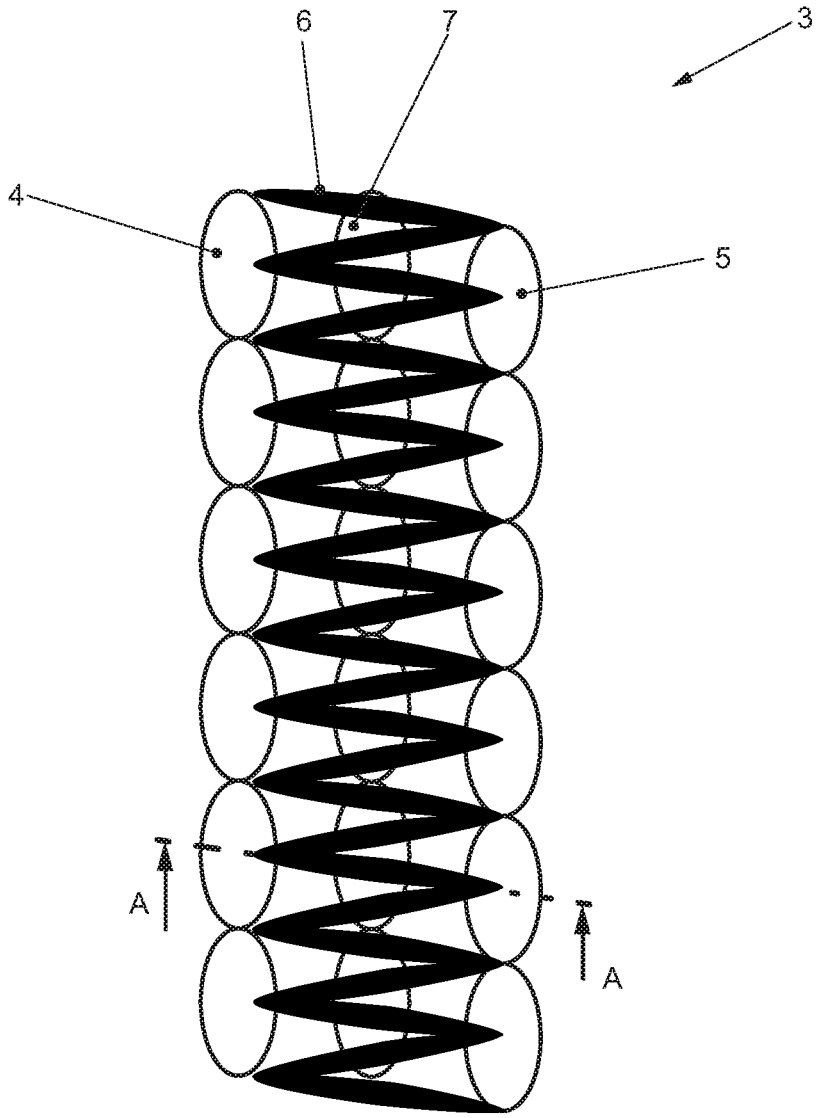
FIG. 5 shows a second design embodiment of the string shown in FIG. 2 in the state as produced.

FIG. 5 shows a second design embodiment of a string 3. It can be seen in this figure that the string 3 after production is configured so as to be flat and strip-shaped, and the third strand 6 runs so as to zigzag between the first strand 4 and the second strand 5. The third strand 6 here straddles in each case the fourth strand 7. The third strand 6 is fixed to the other strands 4, 5, 7 by loop formation.

Figure 6:
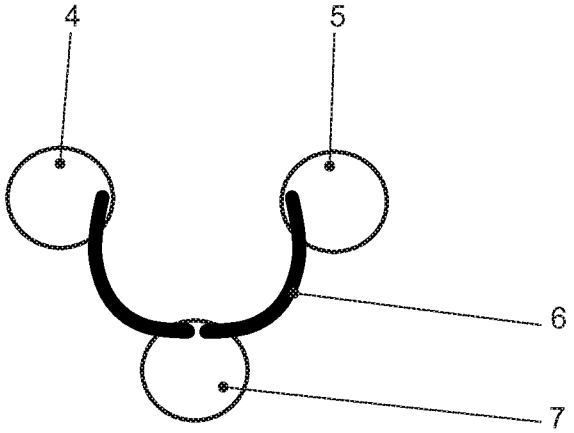
FIG. 6 shows the string shown in FIG. 5 in a sectional view in the section plane A-A.
Figure 6:
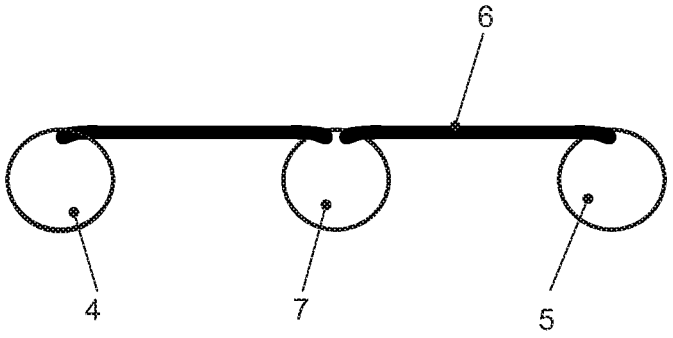

FIG. 6 shows the string 3 shown in FIG. 5 in a sectional view in the section plane A-A. The lower illustration here shows the string 3 during or immediately after production. The string 3 is configured so as to be flat and substantially strip-shaped. The upper illustration shows the string 3 after production, under the effect of the pre-tensioning resulting from production, or under the effect of moisture and/or heat. The string 3 has been deformed in a three-dimensional manner and rolled up so as to form a roll. The first strand 4 and the second strand 5 have moved toward one another.

Figure 7:
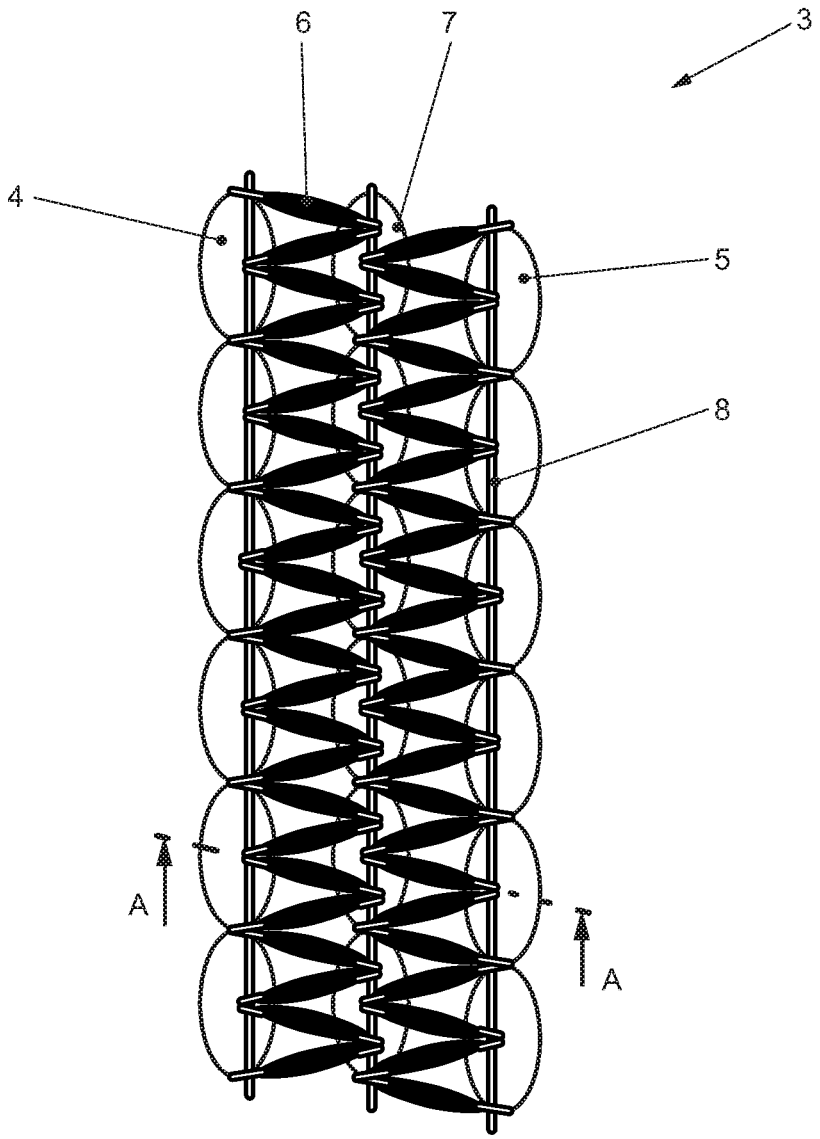
FIG. 7 shows a third design embodiment of the string shown in FIG. 2 in the state as produced.

FIG. 7 shows a third design embodiment of a string 3 according to FIG. 2. It can be seen in this figure that the string 3 after production is configured so as to be flat and strip-shaped, and the third strand 6 runs so as to zigzag between the first strand 4 and the fourth strand 7 as well as between the second strand 5 and the fourth strand 7. The third strand 6 by means of a support thread 8 is fixed to the other strands 4, 5, 7 by loop formation.

Figure 8:
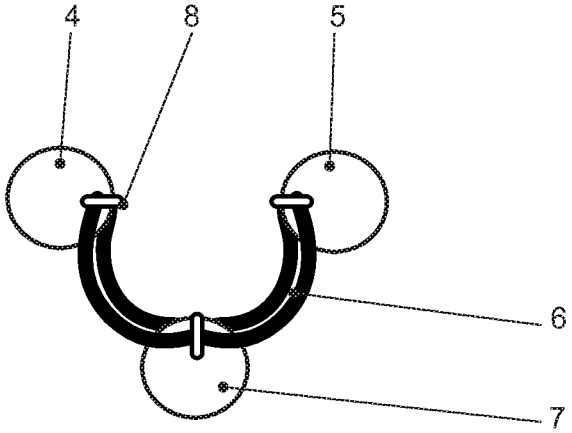
FIG. 8 shows the string shown in FIG. 7 in a sectional view in the section plane A-A.
Figure 8:
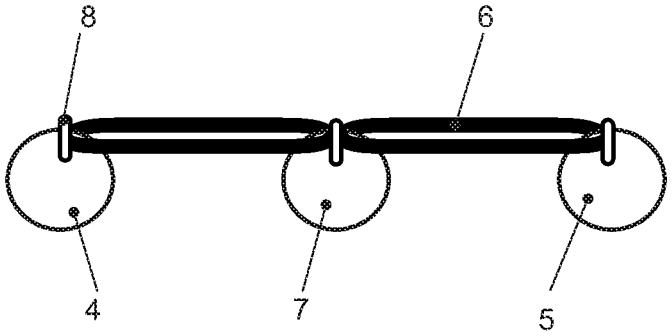

FIG. 8 shows the string 3 shown in FIG. 7 in a sectional view in the section plane A-A. The lower illustration here shows the string 3 during or immediately after production. The string 3 is configured so as to be flat and substantially strip-shaped. The upper illustration shows the string 3 after production, under the effect of the pre-tensioning resulting from production, or under the effect of moisture and/or heat. The string 3 has been deformed in a three-dimensional manner and rolled up so as to form a roll. The first strand 4 and the second strand 5 have moved toward one another.

Figure 9:
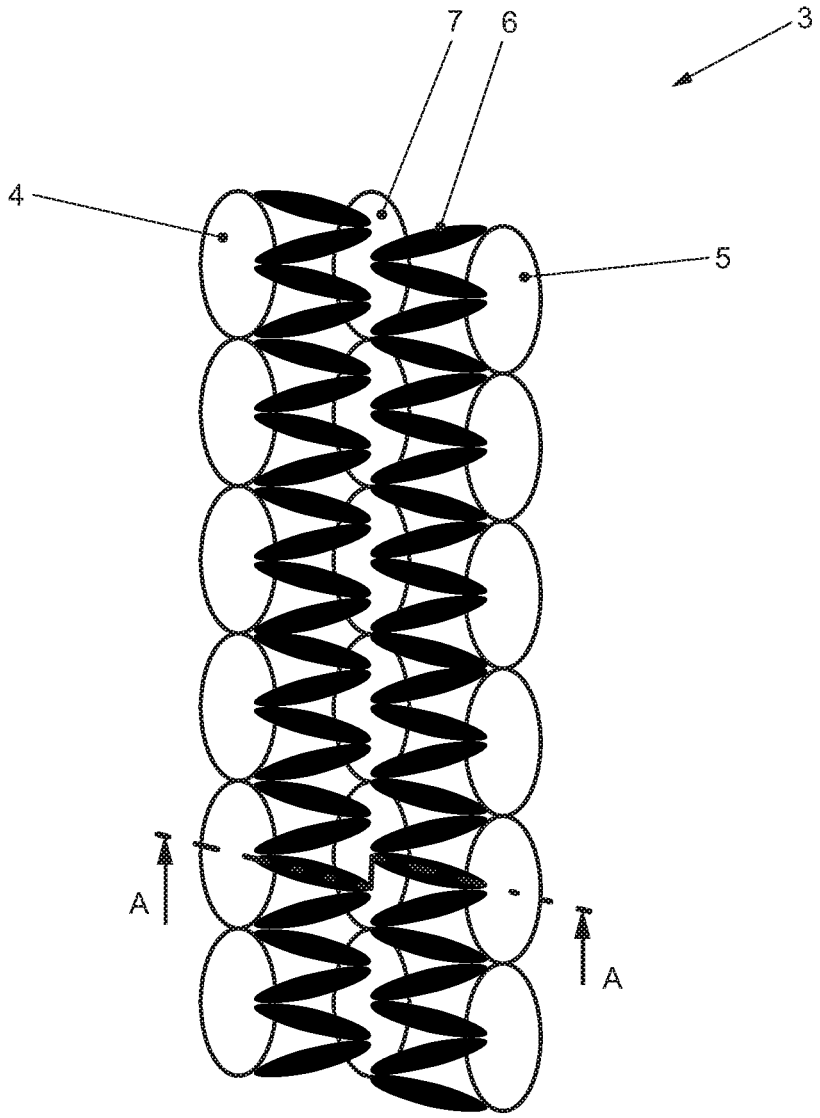
FIG. 9 shows a first design embodiment of the string shown in FIG. 2 in the state as produced.

FIG. 9 shows a fourth design embodiment of a string 3. It can be seen in this figure that the string 3 after production is configured so as to be flat and strip-shaped, and the third strand 6 runs so as to zigzag between the first strand 4 and the fourth strand 7 as well as between the second strand 5 and the fourth strand 7. The third strand 6 is fixed to the other strands 4, 5, 7 by means of loop formation.

Figure 10:
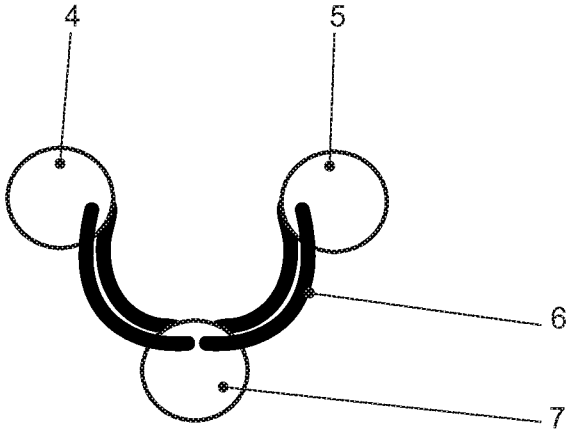
FIG. 10 shows the string shown in FIG. 9 in a sectional view in the section plane A-A.
Figure 10:
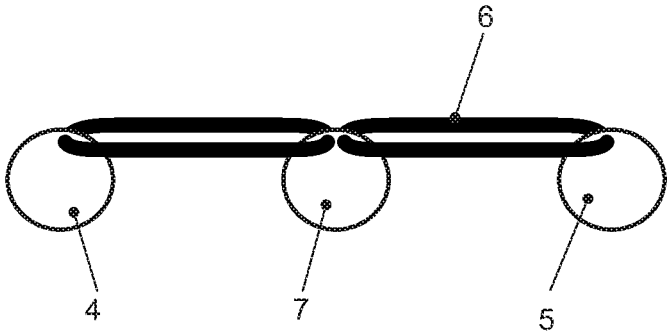

FIG. 10 shows the string 3 shown in FIG. 9 in a sectional view in the section plane A-A. The lower illustration here shows the string 3 during or immediately after production. The string 3 is configured so as to be flat and substantially strip-shaped. The upper illustration shows the string 3 after production, under the effect of the pre-tensioning resulting from production, or under the effect of moisture and/or heat. The string 3 has been deformed in a three-dimensional manner and rolled up so as to form a roll. The first strand 4 and the second strand 5 have moved toward one another.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cleaning element, comprising:

a support body; and textile strings configured to extend from a first elongated end located at the support body to a free second elongated end, wherein each of the textile strings comprises a plurality of strands, wherein a first strand and a second strand of the plurality of strands run longitudinally along a respective textile string of the textile strings, and a third strand of the plurality of strands runs transversely to the longitudinal extent of the respective textile string of the textile strings, wherein the plurality of strands comprises a fourth strand, wherein the fourth strand runs longitudinally along the respective textile string of the textile strings, wherein the fourth strand is disposed between the first strand and the second strand, wherein the first, second, and fourth strands are each fixed to a longitudinally extending support thread by a plurality of stitches, and wherein the third strand runs so as to zigzag between the first strand and the second strand or wherein the third strand runs so as to zigzag between the first strand and the fourth strand and zigzag between the second strand and the fourth strand, and wherein the third strand is directly connected to the respective support strands to connect the plurality of strands.

2. The cleaning element of claim 1, wherein the first strand, the second strand, and the third strand are connected by loop formation.

3. The cleaning element of claim 1, wherein the at least part of the textile strings that comprise the plurality of strands, when viewed in cross section, are shaped so as to be three-dimensional.

4. The cleaning element of claim 1, wherein the plurality of strands and the support thread form a knitted fabric.

5. The cleaning element of claim 1, wherein the plurality of strands comprises a plurality of yarns.

6. The cleaning element of claim 5, wherein the plurality of yarns comprise natural fibers, semi-synthetic fibers, and/or man-made fibers.

7. The cleaning element of claim 1, wherein each of the textile strings has the first longitudinal end and the second longitudinal end opposite the first longitudinal end, and wherein each textile string hangs from the support body at the first longitudinal end and is moveable independent from other textile strings at the second longitudinal end.

* * * * *